United States Patent [19]

Pratt et al.

[11] Patent Number: 4,806,396

[45] Date of Patent: Feb. 21, 1989

[54] POMPON PRIZE DEVICE

[75] Inventors: Richard J. Pratt; James C. King, both of Deerfield, Ill.

[73] Assignee: SG II, Inc., Deerfield, Ill.

[21] Appl. No.: 760,262

[22] Filed: Jul. 29, 1985 (Under 37 CFR 1.47)

[51] Int. Cl.[4] ..... D04D 7/06

[52] U.S. Cl. ..... 428/4; D21/100; 28/147; 428/43; 428/64

[58] Field of Search ..... 15/147 R, 205; 28/147; 40/27.5, 323; 283/51; 428/4, 5, 7, 43, 64; 446/491; D21/100; 273/162 D

[56] References Cited

U.S. PATENT DOCUMENTS

| | | | |
|---|---|---|---|
| D. 284,487 | 7/1986 | Pratt | D21/100 |
| 892,036 | 6/1908 | Emmert | 15/205 |
| 1,014,408 | 1/1912 | Metzger | 428/4 |
| 1,047,703 | 12/1912 | Rapson | 428/4 X |
| 1,527,627 | 2/1925 | Brewer | 428/7 X |
| 1,586,137 | 5/1926 | Zanath | 426/134 X |
| 1,634,907 | 7/1927 | Lester | 15/147 R |
| 1,919,450 | 7/1933 | Rubin | 428/4 |
| 1,958,829 | 5/1934 | Lewin, Jr. | 428/43 |
| 1,984,799 | 12/1934 | Jacobson | 426/134 |
| 2,261,959 | 11/1941 | Buttikofer | 273/162 D |
| 2,810,977 | 10/1957 | Barry | 428/4 X |
| 2,821,481 | 1/1958 | Moslo | 428/16 X |
| 3,560,313 | 2/1971 | Herkimer | 428/4 |
| 3,829,350 | 8/1974 | Davis, Jr. et al. | 428/43 X |
| 3,867,927 | 2/1975 | Hergott | 426/134 X |
| 3,930,084 | 12/1975 | Shields | 428/67 |
| 4,055,840 | 10/1977 | Uchytil et al. | 428/4 X |
| 4,055,858 | 11/1977 | Traenkle | 428/4 X |
| 4,273,816 | 6/1981 | Tollette | 428/35 |
| 4,369,215 | 1/1983 | Offen et al. | 428/4 |
| 4,490,419 | 12/1984 | Sliva | 428/4 |
| 4,514,248 | 4/1985 | Cummings | 156/277 X |
| 4,518,639 | 5/1985 | Phillips | 428/43 X |
| 4,527,719 | 7/1985 | Mackrill | 223/46 X |

*Primary Examiner*—Henry F. Epstein
*Attorney, Agent, or Firm*—Cushman, Darby & Cushman

[57] ABSTRACT

A pompon or similar device for promotions, businesses, institutions, sports, and the like have a pompon, ribbon or tassel portion affixed to a handle portion. The pompon portion is particularly adapted to contain plastic strips, ribbons or the like disclosing particular colors to convey a particular theme or message. The handle portion is particularly adapted to contain a severable redeemable portion or portions as well as a surface for the imprinting of advertisements, messages and the like.

11 Claims, 1 Drawing Sheet

POMPON PRIZE DEVICE

BACKGROUND OF THE INVENTION

This invention generally relates to what is known in the art as pompons and prizes.

Pompons have previously been provided with tassels, strings, strips, ribbons or the like for suitably affixing them to clothing, caps or costumes. There have also been pompons affixed to plastic devices wherein the user's finger is inserted into the center hollow cavity of the plastic device whereby the pompon may be shaken by the user to swirl the strands of the pompon about, see, e.g., U.S. Pat. No. 4,369,215. In this latter instance the pompon strands may be affixed to the plastic receptacle for the user's finger in the conventional manner of a soft pliable metal hoop which is squeezed about the pompon strands. The present invention is concerned with an improved pompon or device with a prize construction, with substantial advantages as hereafter enumerated.

OBJECTS AND SUMMARY OF THE INVENTION

It is an object of the invention to provide an inexpensive pompon which may be conveniently used by the user by simply holding the handle portion in the palm of the user's hand.

It is also an object of the invention to create an extra and additional value to the pompon or similar device by including in combination a prize or redeemable portion for goods or the like which prize or redeemable portion would be accepted by participating advertisers.

Briefly, in accordance with one embodiment, the invention consists of a suitable pompon affixed to a handle portion which can be held in the palm of the user. The handle portion, suitably designed for aesthetics and the comfort of the user, contains a severable portion which may be redeemed for goods or services from participating advertisers. Suitable advertisements are included on the handle portion. The combination may contain in whole or in part the color or design of a particular organization or a theme. It also may be designed for a particular occasion or place.

Further objects and advantages of the present invention will appear from the detailed description of the invention, taken in conjunction with the accompanying drawings.

DETAILED DESCRIPTION OF THE INVENTION

Figure 1:
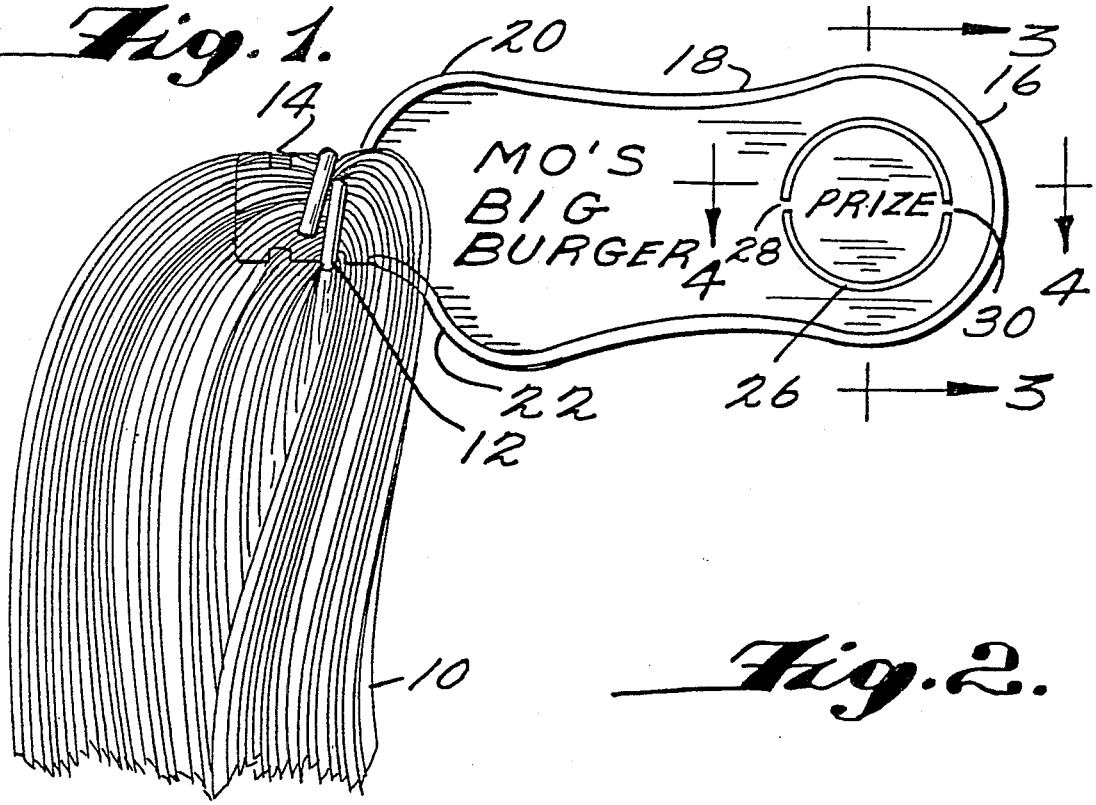
FIG. 1 is a side view of the pompon and handle.
Figure 2:
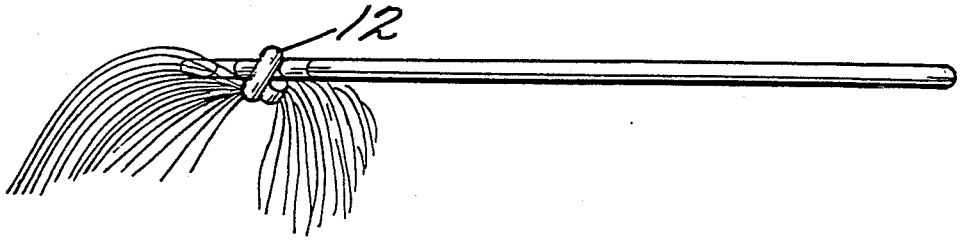
FIG. 2 is a top view of the pompon and handle.

Referring to the drawings, the pompon 10 is shown generally. As shown, the pompon 10 consists of a large number of plastic strips or ribbons, but it may also consist of a tassel, ribbon or other ornament. The pompon 10 is affixed to a handle portion 16 in any conventional manner. As shown the pompon 10 is affixed by a soft, pliable metal wire 12. The handle portion 16 has been provided with grooves 14 about the end portion of the pompon 10. Wire 12 is shown resting in one such groove 14.

Figure 3:
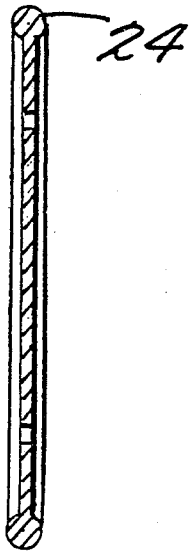
FIG. 3 is a sectional view of the rear portion of the handle as viewed from the front.
Figure 4:
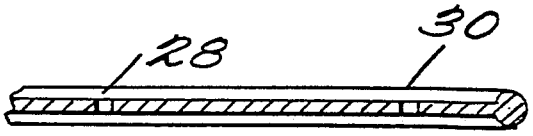
FIG. 4 is a sectional view of the rear portion of the handle as viewed from the top.

The handle portion 16 of the pompon 10 is shown generally in FIG. 1 and may consist of plastic or any other sufficiently inexpensive material. It may be stamped or molded from such materials. The handle portion 16 has been especially designed to conform generally to the hand of the user. By way of example the handle portion 16 lays across the palm of the user generally perpendicular to the fingers of the user. Thus the portion of the palm nearest the thumb would touch generally at curved surface 18 while the thumb would rest generally on curved surface 20. The first finger would rest generally at curved surface 22. The handle portion 16 as shown can have a second pompon affixed thereto by virtue of grooves 14. The handle portion 16 is shown with a generally beaded or rounded portion 24, seen best in FIG. 3, for the convenience and comfort of the holder.

The handle portion 16 includes a severable portion 26. This severable portion 26 is a part of the handle portion 16 and is joined thereto by two connecting strips 28 and 30. The severable portion 26 is circular and resembles a coin. It is easily severed from the handle portion 16 by breaking the two strips 28 and 30.

The severable coin-like portion 26 may be imprinted with suitable advertising messages which allows the owner of the pompon 10 to remove the coin-like disc and present it to a redeemer such as a beverage manufacturer, distributor or seller. The handle portion 16 also contains suitable space for advertising messages.

In operating the pompon 10 may be either sold to ultimate users or given free by sponsors. The pompon 10 may carry a message, color, theme, emblem, or the like to designate a manufacturer, distributor, retailer, institution, sports team, individual, place or the like. The pompon 10, while generally designed to be held in the palm, may be suitably affixed to clothing and other objects.

The pompon 10 may be in multiple colors or multiple pompons as may the handle portion 16 have multiple severable portions 26 without departing from the scope of the invention.

Having described the invention what is claimed is as follows.

What is claimed:

1. A pompon assembly comprising a thin, plate-like handle portion of generally uniform thickness adapted to be grasped by a users hand, the handle portion having an opening therethrough in the thickness direction, a severable piece having indicia thereon located in the opening, the severable piece having a thickness generally equal to the thickness of the handle portion and being connected to the handle portion by breakable strip means; a flexible pompon portion of greater surface area than the handle portion; and means connecting the pompon portion to the handle portion at a a location spaced such that the severable piece is visible to the user of the assembly.

2. A pompon assembly as in claim 1 wherein said severable piece is a coin-like portion.

3. A pompon assembly comprising: an elongated plate-like handle portion adapted to be grasped in one hand, said handle portion having a longitudinal dimension, a width of lesser magnitude than the longitudinal dimension and a thickness which is less than the width and which is generally uniform over the length and width of the handle portion, said handle portion having an opening therethrough in the thickness direction; a severable piece within and essentially filling said opening, said severable piece having a thickness essentially equal to the thickness of the handle portion and being connected to said handle portion by breakable strip means, a flexible pompon portion; and means connecting the pompon portion to an end of said handle portion at a location spaced from the severable piece so that the latter is visible to a user of the assembly.

4. A pompon assembly as in claim 3 wherein said severable piece is a coin-like portion.

5. A pompon assembly as in claim 3 wherein the severable piece is located at the end of the handle portion opposite the pompon portion.

6. A pompon assembly as in claim 3 wherein each edge of the handle portion extending between the ends of the handle portion has a gently concave contour so as to fit the palm and fingers of a hand.

7. A pompon assembly comprising: a thin, plate-like handle portion of generally uniform thickness adapted to be grasped by a user's hand, the handle portion having an opening therethrough in the thickness direction, the surface of the handle portion through which the opening extends having promotional indicia thereon; a severable redeemable piece having indicia thereon located in the opening, the severable piece being connected to the handle portion by breakable strip means; a flexible pompon portion of greater surface area than the handle portion; and means connecting the pompon portion to the handle portion at a location spaced from the severable piece such that the severable piece is visible to the user of the assembly.

8. A pompon assembly comprising a unitary handle portion having a severable piece, a flexible pompon portion and means connecting the pompon portion to the handle portion, the unitary handle portion further comprising a thin, plate-like portion of generally uniform thickness adapted to be grasped by the user's hand, the handle portion having an opening therethrough in the thickness direction with an integral severable piece located in the opening and being connected to the handle portion by breakable strip means, the surface of the handle portion through which the opening extends having indicia thereon and the severable piece located in the opening having indicia thereon; a flexible pompon portion of greater surface area than the unitary handle portion; and means connecting the pompon portion to the unitary handle portion at a location spaced from the severable piece such that the severable piece is visible to a user of the pompon assembly.

9. A pompon assembly intended for use at sporting events by spectators, comprising a pompon portion and a handle portion with means for connecting the pompon portion to the handle portion; said means for connecting the handle portion to the pompon portion being at one end of the handle portion; said handle portion being of unitary construction further comprising a thin oblong shape which is held in the user's hand, said shape being designed to fit the user's hand with the pompon portion being visable when in use and capable of showing a university or college or professional team's identifying colors; said thin oblong shape having a width substantially greater than its peripheral height when placed in the user's hand and a thickness substantially less than its peripheral height when placed in the user's hand; said handle portion being of integral one piece construction having a surface area across its width capable of carrying a message thereon and having a severable portion connected by breakable strip means to the handle portion and containing therein which is capable of carrying a message thereon.

10. An assembly according to claim 3 wherein said handle portion is adapted to have promotional indicia thereon, and wherein said severable piece is also adapted to have promotional indicia thereon.

11. An assembly according to claim 3, wherein said handle portion is unitary.

* * * * *